US005899430A

United States Patent [19]

Malakates et al.

[11] Patent Number: 5,899,430

[45] Date of Patent: May 4, 1999

[54] WALL HANGING DEVICE

[76] Inventors: Michael Malakates; Anthony Malakates, both of 225 NW. 26th St., Miami, Fla. 33127

[21] Appl. No.: 08/961,660

[22] Filed: Oct. 31, 1997

[51] Int. Cl.[6] ..... A47G 1/16

[52] U.S. Cl. ..... 248/489; 248/490

[58] Field of Search ..... 248/489, 490, 248/468, 475.1, 476, 477, 497, 498, 466

[56] References Cited

U.S. PATENT DOCUMENTS 3,138,359 6/1964 Stewart ..... 248/490

3,176,943 4/1965 Hughes ..... 248/490

5,685,516 11/1997 Simmons ..... 248/489

*Primary Examiner*—Ramon O. Ramirez

*Assistant Examiner*—Willie Berry, Jr.

*Attorney, Agent, or Firm*—Alfred E. Miller

[57] ABSTRACT

A heavy duty suspension device for attachment to a wall, and which includes a turnbuckle assembly provided with triangular-shaped retaining members for attachment to hooks at the ends of bars which are secured respectively to the object to be suspended, as well as the wall.

8 Claims, 4 Drawing Sheets

WALL HANGING DEVICE

The present invention relates to a heavy duty suspension device for items like pictures, mirrors and the like. The hanger device is especially useful for museums and exhibits where extremely valuable paintings are exhibited.

Hangers and picture hooks are known, some of which are adjustable. For example U.S. Pat. No. 2,697,572 to Pfankuch, U.S. Pat. No. 2,522,901 to Schrager et al. and U.S. Pat. No. 2,682,383 to Horwitz show picture or mirror hanging or supporting devices which are attached to a wall, however none of these patents disclose a suspension or supporting device particularly suitable for heavy duty. The present device is designed specifically for suspending art works, especially those that are large and heavy. In addition, the present hanger device can be utilized to hang and support heavy mirrors.

SUMMARY OF THE INVENTION

It is an important feature of the present invention to provide a picture hanger assembly which utilizes a hook for attachment to the wall or the like preferably fabricated of metal stock, an adjustable turnbuckle having threaded rods at opposite ends with triangular shaped hook or strap holders, and mounting brackets preferably of metal stock for supporting the object to be hung.

An object of the present invention is to provide a direct wall mounted supporting device that eliminates the use of picture wire and which securely supports a heavy object, the orientation of which can be easily adjusted after the object is hung on the wall.

A further object of the present invention is the capability of an accurate adjustment of a picture or mirror in less time than was necessary previously. Therefore, even if the wall suspension of an object, such as a large picture, was incorrectly installed the error can be corrected in situ without the necessity for removing the picture from the wall in order to make the adjustment.

A further feature of the present invention is to provide a compact heavy duty installation for suspending objects of considerable weight directly to the wall.

DESCRIPTION OF THE DRAWINGS

In order that the invention may be more clearly understood, it will now be disclosed in greater detail with reference to the accompanying drawings in which.

DESCRIPTION OF THE PREFERRED EMBODIMENTS

Figure 1:
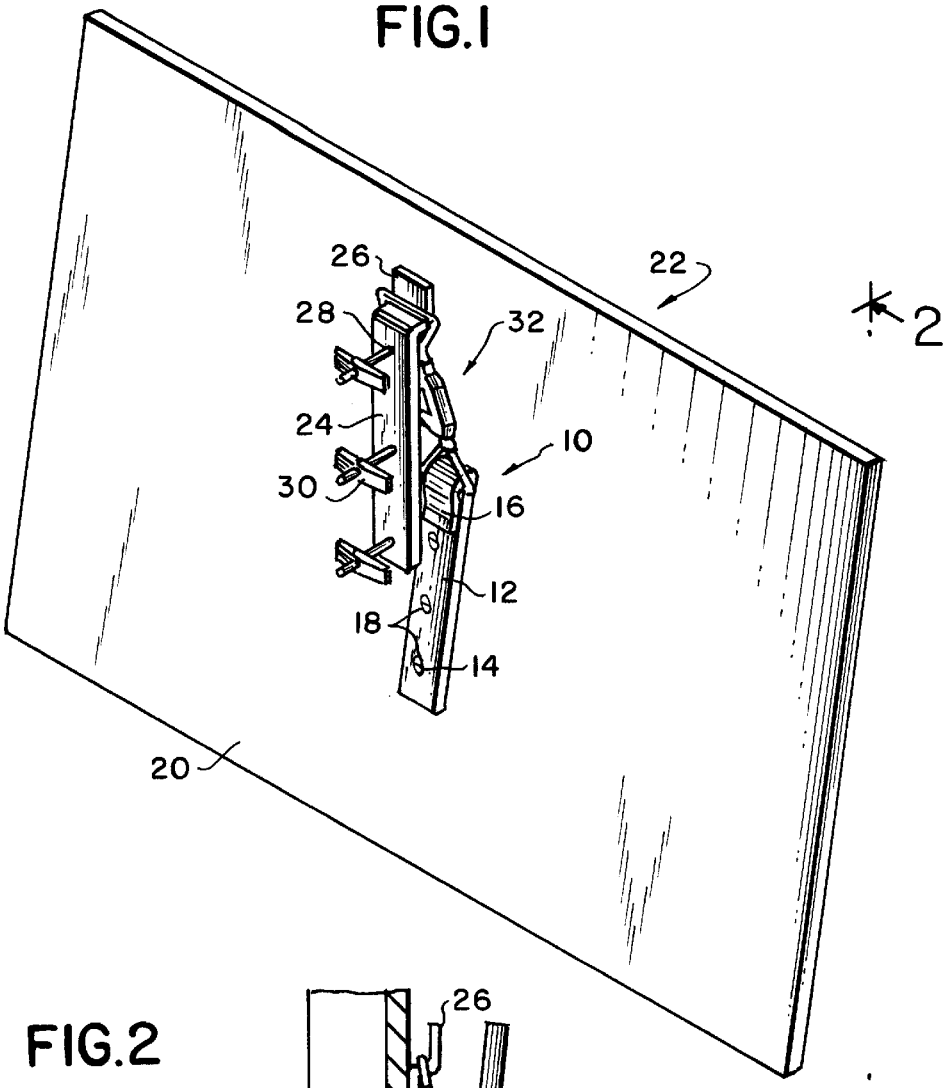
FIG. 1 is a perspective view of my wall hanging device constructed in accordance with the teachings of my invention and secured to the back of an object, such as a picture or a mirror.

The wall hanging device of the present invention is shown in it's entirety in FIGS. 1–4, while details of the assembly, together with an alternate embodiment, is shown in FIGS. 5–16.

The wall hanging or suspension device referred to generally by the reference numeral 10 is heavy duty that is utilized in the mounting, for example, pictures and other heavy and valuable objects on museum walls. The hanging or suspension assembly comprises a mounting bar 12 with a series of spaced holes 14 and having an integral hook 16. The bar 12 is mounted on the back panel 20 of a painting or other heavy object identified by the reference numeral 22, and is secured by screws or the like 18.

Figure 2:
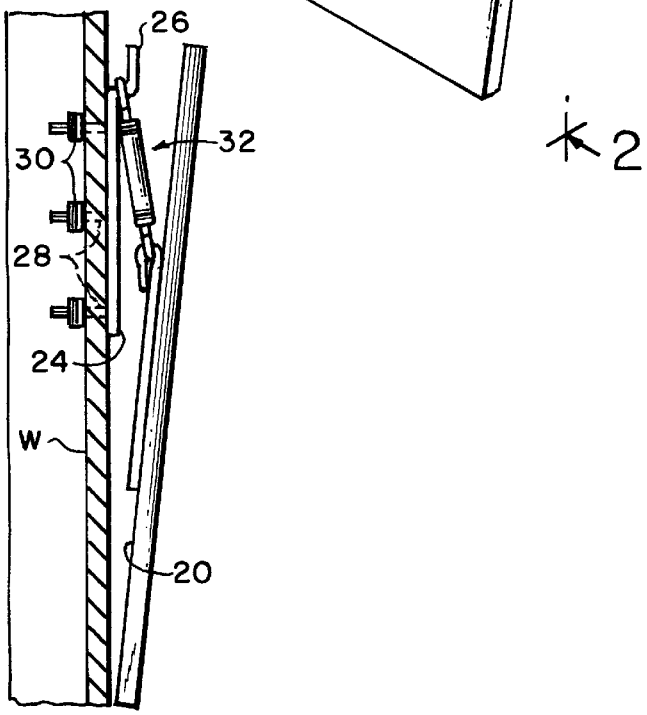
FIG. 2 is a view taken along the lines 2—2 of FIG. 1 showing the wall hanging device of FIG. 1 in place on a wall.
Figure 3:
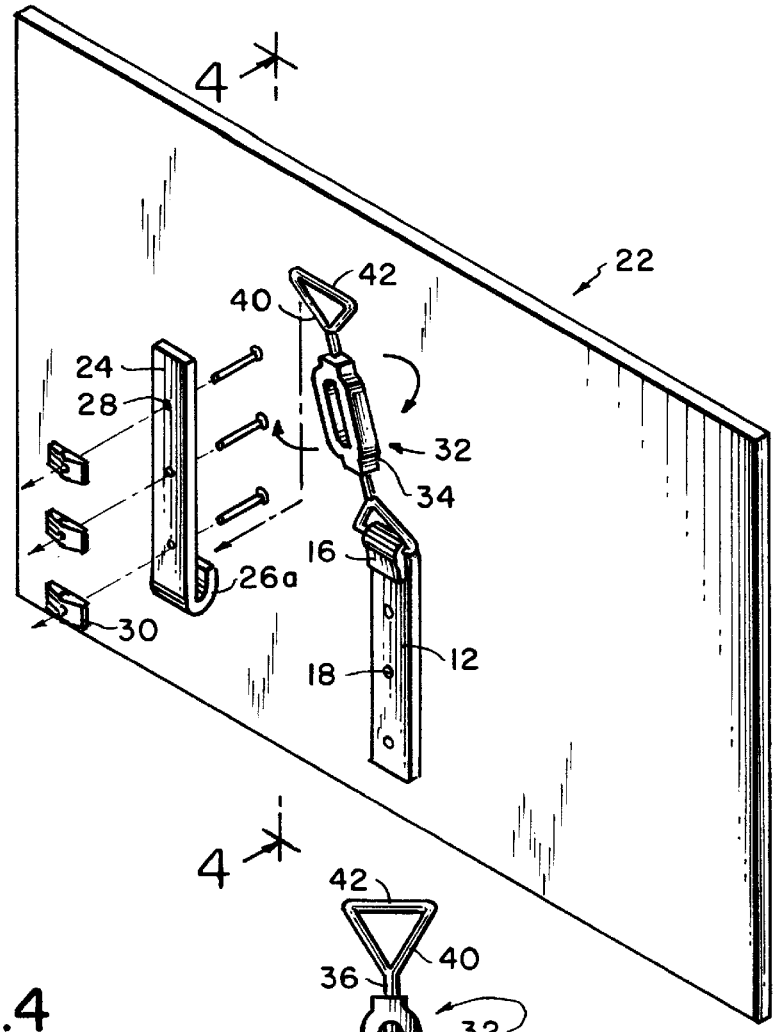
FIG. 3 is a perspective exploded view of the wall hanging device showing the attachments for both the wall and the object being suspended.
Figure 4:
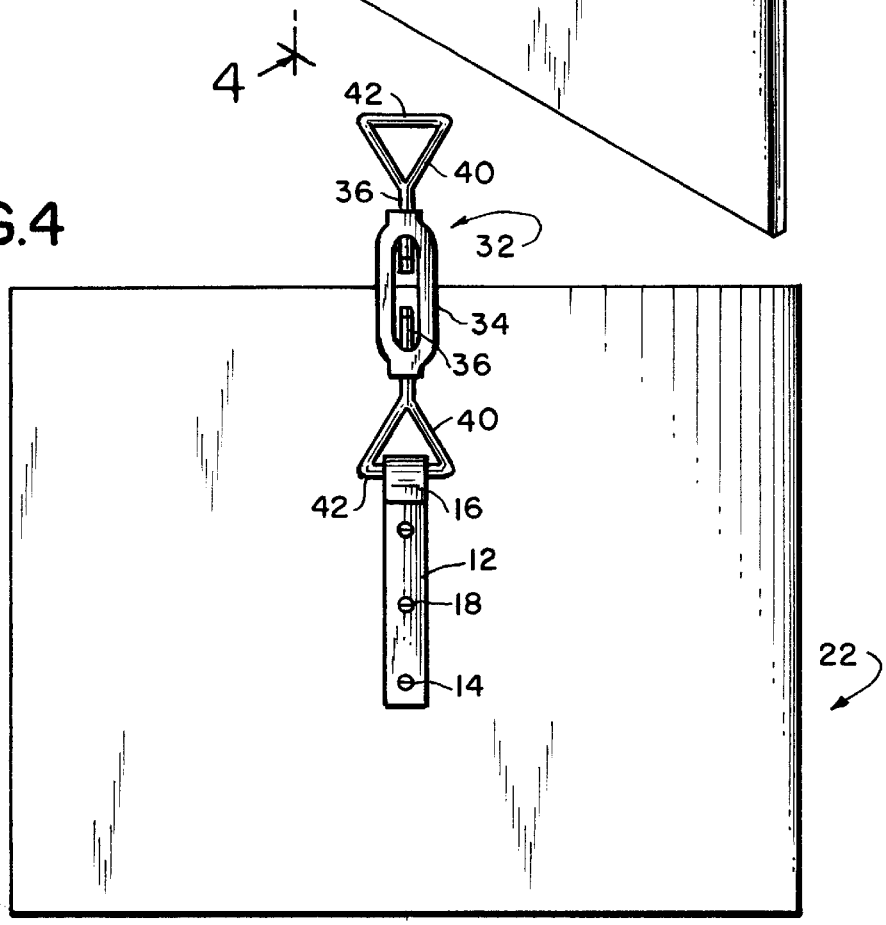
FIG. 4 is a view taken along the lines 4—4 of FIG. 3.
Figure 5:
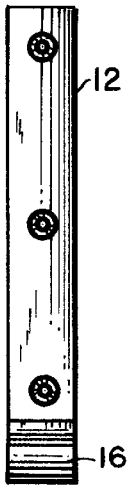
FIG. 5 is a front elevational view of a hook for mounting an object on a wall as part of the wall hanger assembly.
Figure 6:
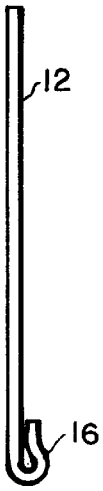
FIG. 6 is a side elevational view of the hook shown in FIG. 5.
Figure 7:
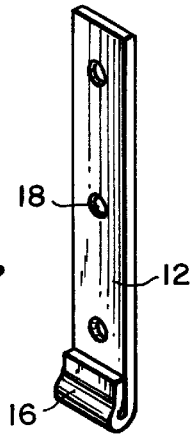
FIG. 7 is a perspective view of the hook shown in FIG. 5
Figure 11:
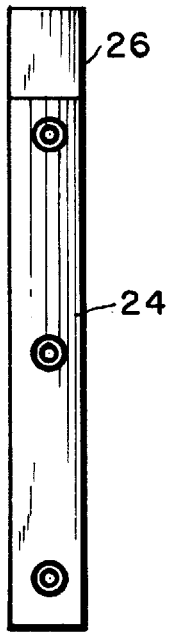
FIG. 11 is a front elevational view of an embodiment of the invention in which the wall mounting is a heavy duty bar having an offset portion functioning as a wall support for turnbuckle assembly.
Figure 12:
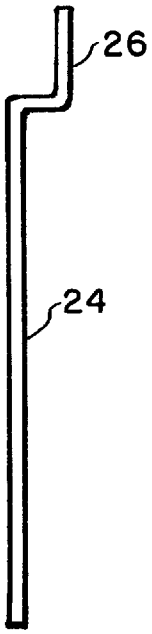
FIG. 12 is a side elevational view of the support element shown in FIG. 11.
Figure 13:
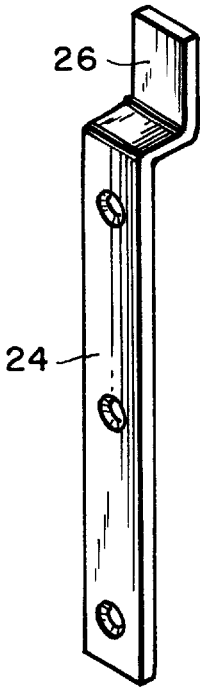
FIG. 13 is a perspective view of the support element shown in FIG. 11.
Figure 14:
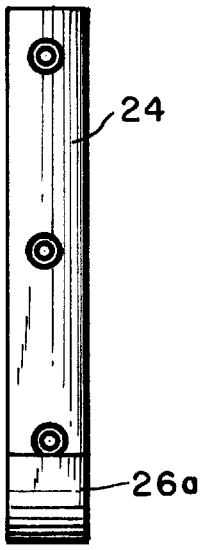
FIG. 14 is an alternate embodiment of the invention in which the wall mounting is a heavy duty hook for supporting the turnbuckle assembly.
Figure 15:
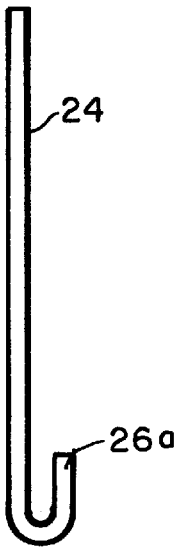
FIG. 15 is a side elevational view of the hook shown in FIG. 14.
Figure 16:
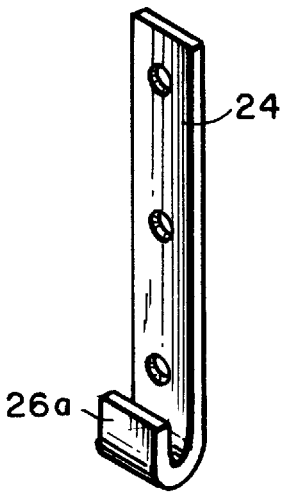
FIG. 16 is a perspective view of the hook shown in FIG. 14.

Another bar 24 is used for attachment to a wall W, and as seen in FIGS. 1 and 2, as well as FIGS. 11–13 is provided with an upright hook 26. The bar 24 is also provided with a series of spaced holes 28 through which wall anchors 30 pass and are connected behind wall W in order to securely hold an object suspended from the wall W. As seen in FIG. 3, the bar 24 may alternatively be provided with a hook 26*a* at the lower end of the bar.

Figure 8:
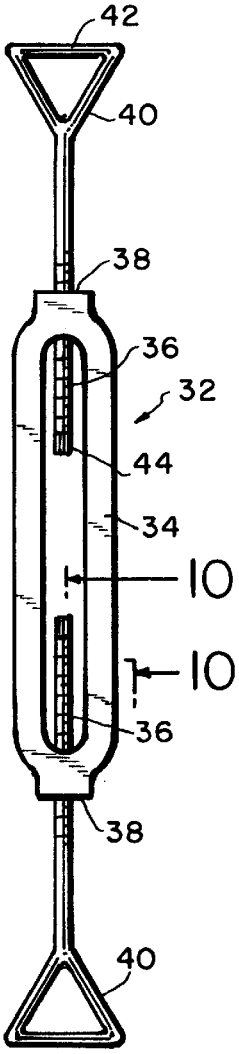
FIG. 8 is a front elevational view of the turnbuckle assembly which is connected at one end to a wall mounted bracket and at the other end to a hook which is secured to an object to be suspended from the wall.
Figure 9:
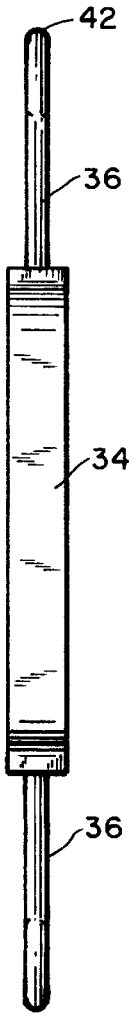
FIG. 9 is a side elevational view thereof.
Figure 10:
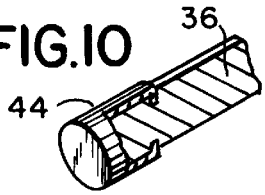
FIG. 10 is a view taken along lines 10—10 of FIG. 8 showing an enlarged detail of construction.

In order to complete the suspension assembly a turnbuckle assembly referred to generally by the reference numeral 32 is shown in FIGS. 8 and 10 having a turnbuckle body 34 and a pair of oppositely directed threaded rods 36 that are screw connected through internally threaded holes 38. The rods 36 are provided with triangular shaped end members 40 having a planar base surface 42. As seen more specifically in FIG. 10, the end of the threaded rod 36 remote from the end member 42 is provided with an end cap 44 functioning as a stop to prevent the threaded rods 36 from being completely unscrewed from the turnbuckle body 34 when adjusting the location of the suspended object on the wall W.

Since each triangular end member 40 has a planar, wide base surface 42 for engaging the hook 16 of the bar 12 that is affixed to the back of a picture, and since the other end of said turnbuckle assembly likewise has another triangular shaped end member 40 having a planar, wide base surface 42 for engaging the hook 26 or 26*a* of the bar 24, which is securely attached to a wall W, a superior hanging or suspension device, although heavy duty, can nevertheless be easily and rapidly adjusted in place by reaching behind a picture, or the like, and rotating the turnbuckle body 34 either clockwise or counter-clockwise in order to raise or lower the picture to a desired location.

While there has been shown and described several embodiments of the present invention, it will be understood that various changes in the form and details of the device illustrated without departing from the spirit of the invention. It is intended, therefore, only to be limited as indicated by the scope of the claims appended hereto.

What is claimed is:

1. A wall suspension device for a heavy object comprising a first attachment member having a first hook member, means for securing said first attachment member to said wall, a second attachment member having a second hook member spaced from said first hook member and supporting said object, an intermediate turnbuckle member having a turnbuckle body provided with threaded rods at opposite ends of said turnbuckle body, each of said rods at one end having a loop wherein the part of said loop remote, from said turnbuckle body is planar, and the other end of said threaded rod is provided with a stop member to prevent disengagement of the threaded rod from the turnbuckle body, and said first and second hook members gripping adjacent planar parts of said loops for suspending said heavy object.

2. The wall suspension device of claim 1 wherein said loop is substantially triangular-shaped having a base, and said base of said triangular-shaped loop being planar.

3. The wall suspension device of claim 1 wherein said first attachment member is an elongated bar having said hook at bottom end of said bar.

4. The wall suspension device as claimed in claim 3 further comprising means for securing said elongated bar to said wall.

5. The wall suspension device as claimed in claim 1 wherein said first attachment member is an elongated bar having a hook offset from said bar located at the top end of said bar.

6. The wall suspension device as claimed in claim 5 further comprising means for securing said elongated bar to said wall.

7. The wall suspension device as claimed in claim 1 wherein said hooks of said first and second attachment members each has a width dimension to engage substantially all of the planar part of each of said loops.

8. The wall suspension device as claimed in claim 1 wherein said stop member is an end cap.

* * * * *